US005321969A

United States Patent [19]

Bakermans

[11] Patent Number: 5,321,969

[45] Date of Patent: Jun. 21, 1994

[54] STAMPING AND FORMING MACHINE HAVING ADJUSTABLE STROKE RAMS

[75] Inventor: Johannes C. W. Bakermans, Harrisburg, Pa.

[73] Assignee: The Whitaker Corporation, Wilmington, Del.

[21] Appl. No.: 968,012

[22] Filed: Oct. 29, 1992

[51] Int. Cl.[5] ..... B21D 7/06; B21S 9/18

[52] U.S. Cl. ..... 72/407; 72/450; 72/452; 72/441; 100/257

[58] Field of Search ..... 100/257; 72/407, 452, 72/441, 450, 446

[56] References Cited

U.S. PATENT DOCUMENTS

| | | | |
|---|---|---|---|
| 3,888,104 | 6/1975 | Ribback | 72/452 |
| 4,497,196 | 2/1985 | Bakermans et al. | 72/405 |
| 4,819,476 | 4/1989 | Bakermans et al. | 72/456 |
| 4,934,173 | 6/1990 | Bakermans et al. | 72/452 |

FOREIGN PATENT DOCUMENTS

| | | | |
|---|---|---|---|
| 0259336 | 1/1968 | Austria | 72/407 |
| 3230845 | 2/1984 | Fed. Rep. of Germany | 72/407 |
| 3446711 | 7/1985 | Fed. Rep. of Germany | 100/257 |
| 0070436 | 5/1980 | Japan | 72/407 |
| 0004341 | 1/1981 | Japan | 72/407 |
| 0121002 | 6/1985 | Japan | 72/407 |

*Primary Examiner*—David Jones

[57] ABSTRACT

Stamping and forming machine having reciprocable rams which move towards and away from each other between open and closed positions having adjustable eccentrics for adjusting the strokes of the rams. The rams are reciprocated by oscillating levers which are coupled to a power shaft by eccentric assemblies. Each eccentric assembly has a fixed eccentric on the power shaft and an adjustable eccentric which is rotatable, for adjustment purposes, with respect to the fixed eccentric thereby to change the stroke of the associated ram assembly.

23 Claims, 11 Drawing Sheets

STAMPING AND FORMING MACHINE HAVING ADJUSTABLE STROKE RAMS

FIELD OF THE INVENTION

This invention relates to stamping and forming machines of the type having first and second rams which are reciprocable in a horizontal plane towards and away from each other and which have tooling on their ends for performing operations on strip material which is fed along a strip feed path that extends between the rams. The invention is particularly concerned with the provision of adjustable stroke features for the ram assemblies.

RELATED PUBLICATIONS

U.S. Pat. Nos. 4,497,196 and 4,819,476 are incorporated into this description by reference.

BACKGROUND OF THE INVENTION

The above-identified U.S. Patents describe a stamping and forming machine having first and second ram assemblies which are reciprocable towards and away from each other along horizontal paths of reciprocation. Strip material is fed along a strip feed path which extends between the ram assemblies and the ram assemblies have tooling on their ends for performing stamping and forming operations on the strip. The ram assemblies are reciprocated by oscillating levers to which they are coupled. The levers, in turn, are coupled to a central power shaft by eccentric assemblies.

The eccentric assemblies and the levers of the above-identified U.S. Patents are such that the ram assemblies have a fixed stroke. Most stamping presses have fixed, rather than adjustable, strokes and a fixed stroke machine is satisfactory for many stamping and forming operations. However, it would be desirable to provide a system for adjusting the strokes of the ram assemblies of the machines described in the above-identified patents. Assuming that the motor which rotates the power shaft of the machine has a fixed torque, an adjustable stroke system would permit the force exerted on the strip material to be varied by changing the stroke. The present invention is directed to improvements in stamping and forming machines which permit adjustment of the strokes of the machine for different stamping and forming operations.

THE INVENTION

The invention comprises a stamping and forming machine having first and second aligned ram assemblies which are reciprocable towards and away from each other along paths of reciprocation between retracted positions and forward positions. First and second levers are provided for reciprocating the ram assemblies, one end of each lever being coupled to its associated ram assembly. The levers are pivotally mounted on first and second pivotal axes and a power shaft is provided between these pivotal axes. The first and second levers are coupled to the power shaft by first and second eccentric assemblies. The machine is characterized in that the first eccentric assembly comprises a first fixed eccentric, a first adjustable eccentric, and a first crank. The second eccentric assembly comprises a second fixed eccentric, a second adjustable eccentric, and a second crank. Each of the fixed eccentrics is fixed to the power shaft and each of the adjustable eccentrics surrounds its associated fixed eccentric. The adjustable eccentrics are rotatable, for adjustment purposes, with respect to their associated fixed eccentrics. Each of the cranks extends from its associated adjustable eccentric to its associated lever and is pivotally connected to the lever whereby the lengths of the strokes of the ram assemblies can be changed by adjusting the positions of the adjustable eccentrics.

In the preferred embodiment, a disengageable securing means is provided for securing the adjustable eccentrics in position relative to their associated fixed eccentrics, the securing means being disengageable when the adjustable eccentrics are adjusted. A single adjusting control means can be provided for simultaneously disengaging the securing means of the eccentric assemblies, for adjusting the positions of the adjustable eccentrics, and for then re-engaging the securing means so that the adjustable eccentrics are then secured on the fixed eccentrics.

THE DRAWING FIGURES

FIG. 1 is an end view of a stamping and forming machine.

FIGS. 2 and 3 are views looking in the direction of the arrows 2—2 and 3—3 of FIG. 7. These views show diagrammatically the essential parts of the eccentric assemblies of the machine.

Figure 9:
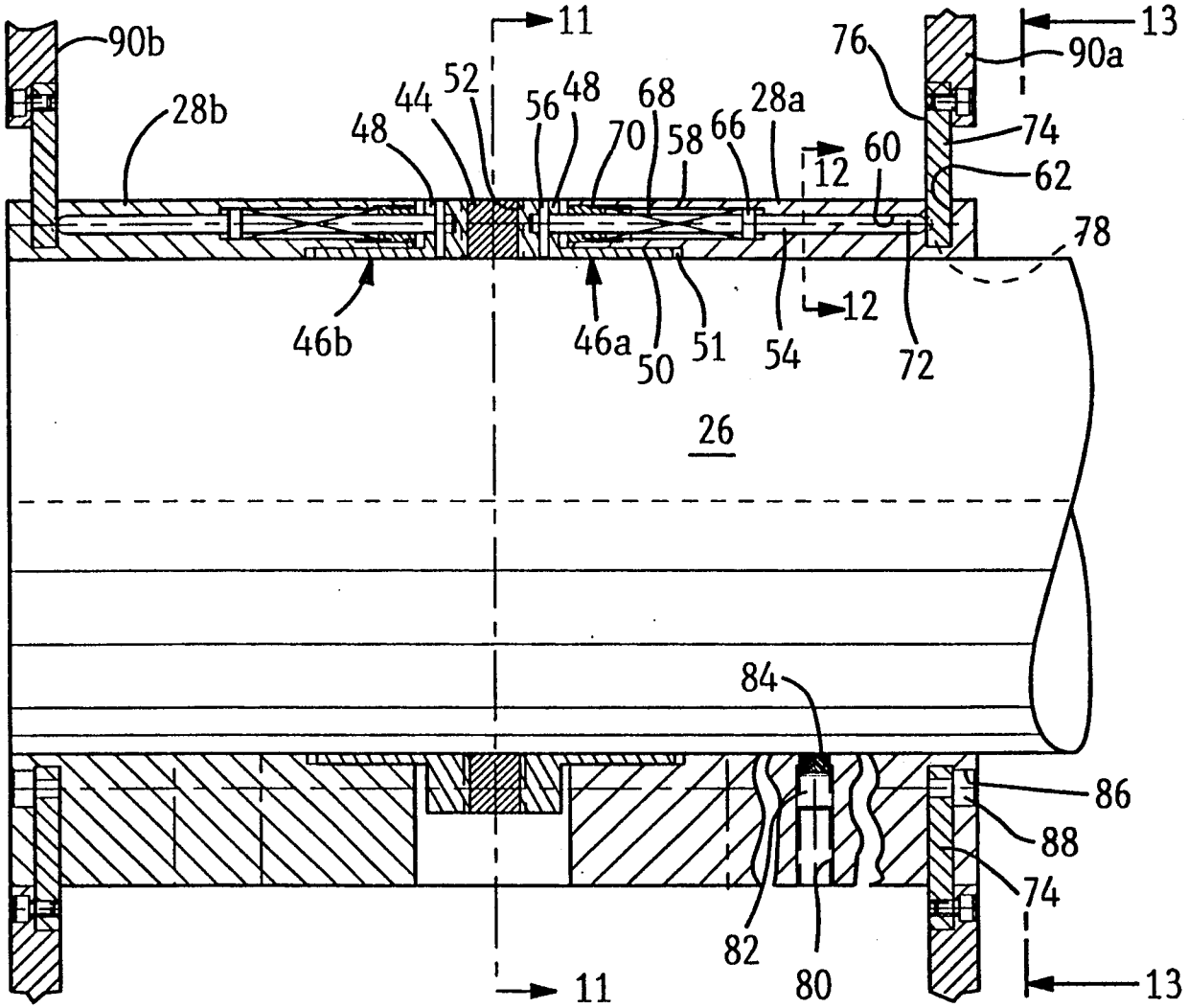
FIG. 9 is a fragmentary view on an enlarged scale showing features of the first eccentric assembly.
Figure 11:
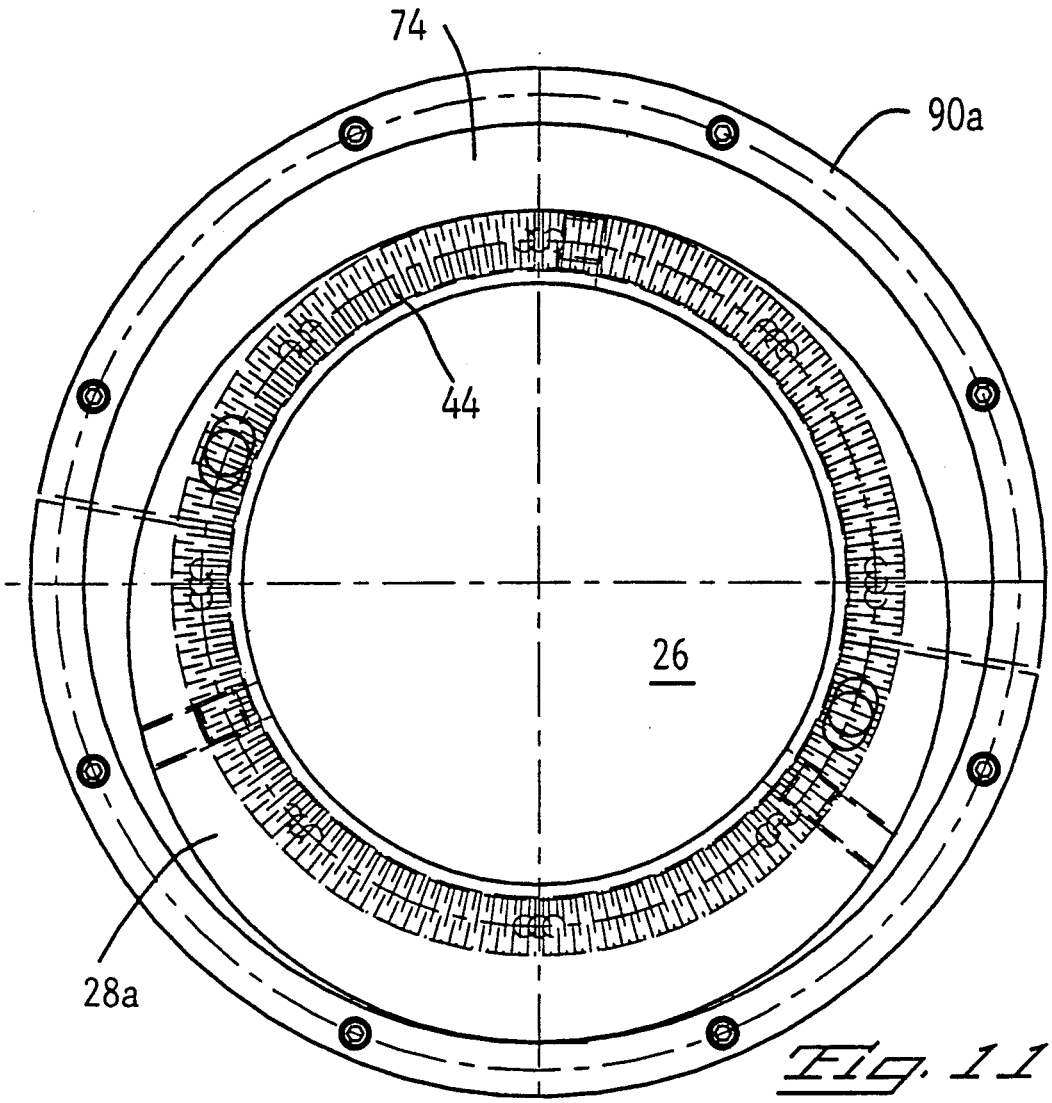
Figure 12:
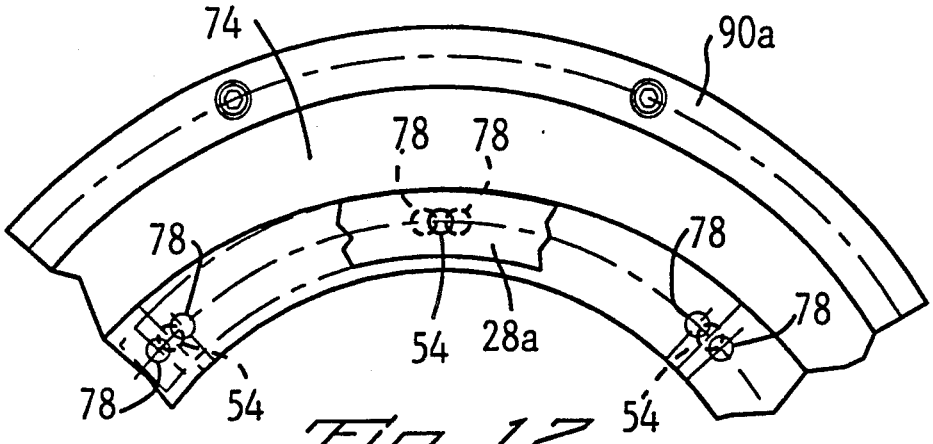
Figure 13:
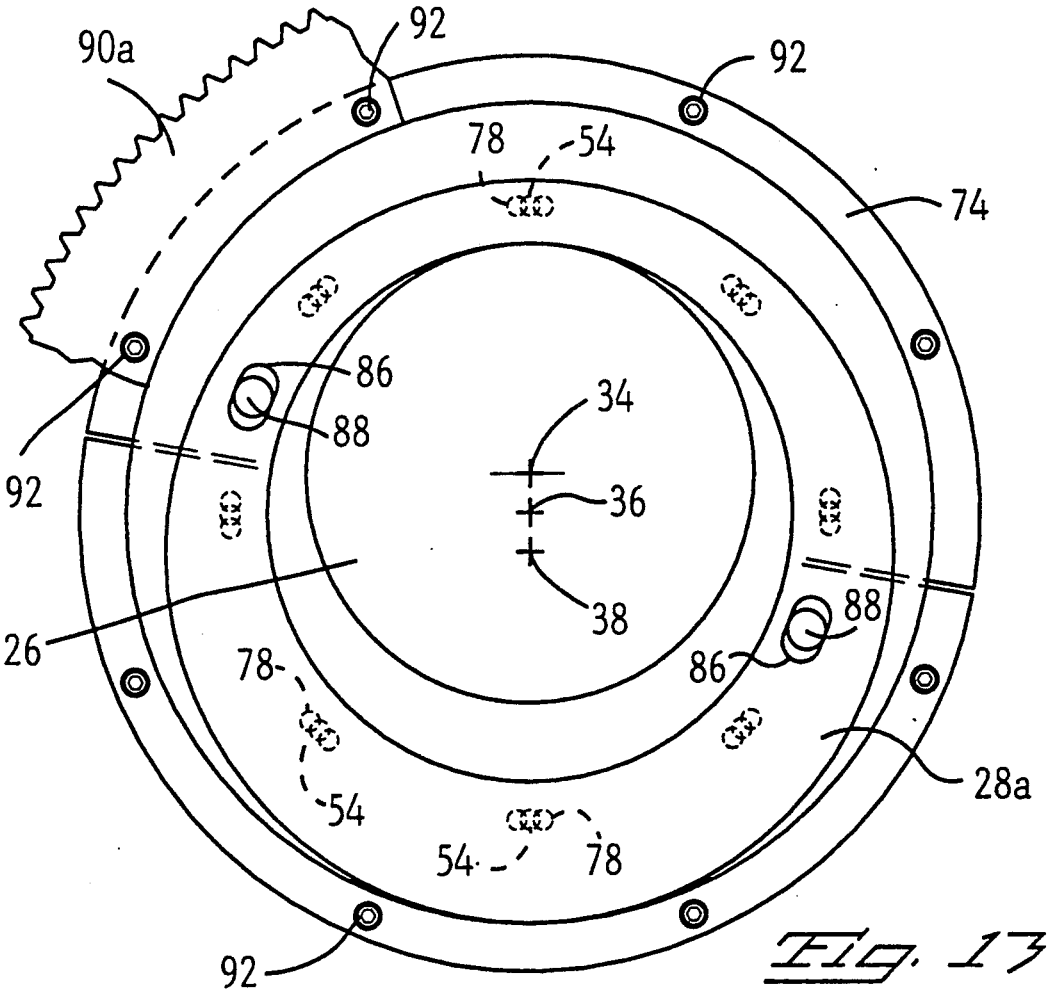

FIGS. 11, 12, and 13 are views looking in the directions of the arrows 11—11, 12—12, and 13—13 of FIG. 9.

Figure 10:
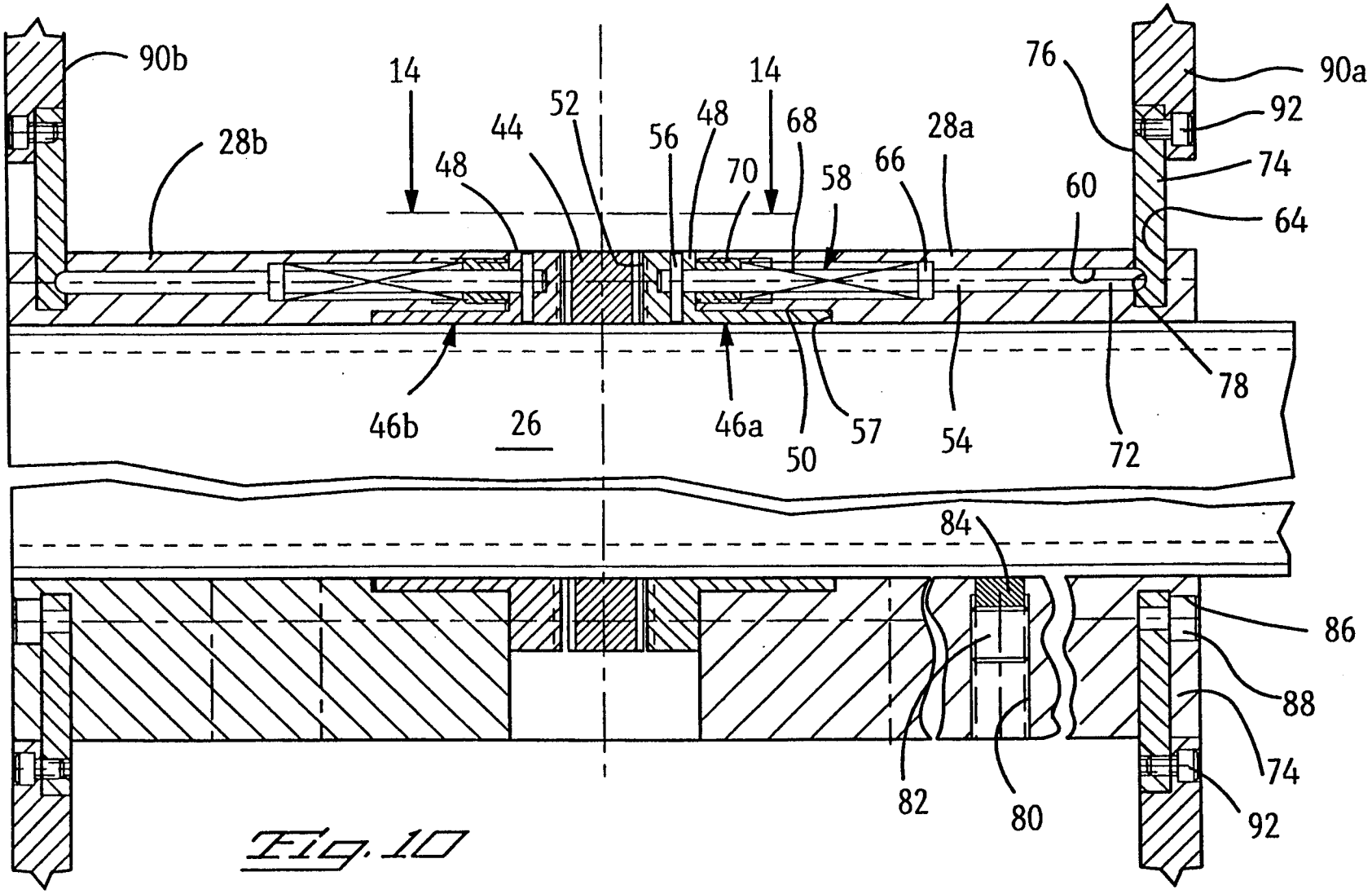
FIG. 10 is a view similar to FIG. 9 showing the positions of the parts when the position of the adjustable eccentric is being changed.
Figure 14:
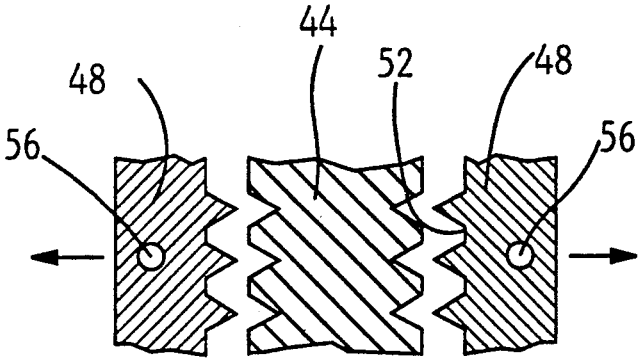

FIG. 14 is a view looking in the direction of the arrows 14—14 of FIG. 10.

Figure 8:
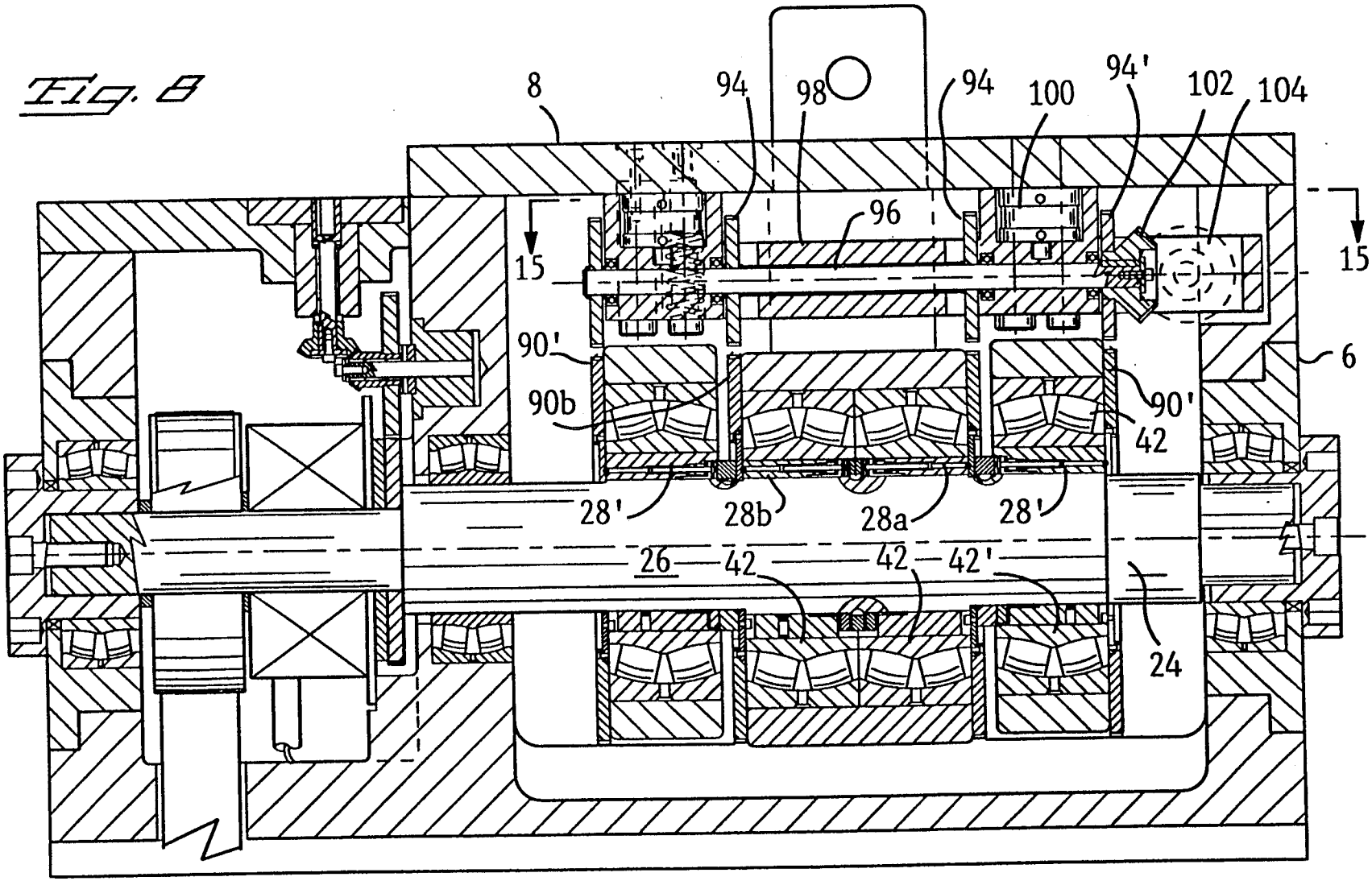
FIG. 8 is a longitudinal section looking in the direction of the arrows 8—8 of FIG. 6.
Figure 15:
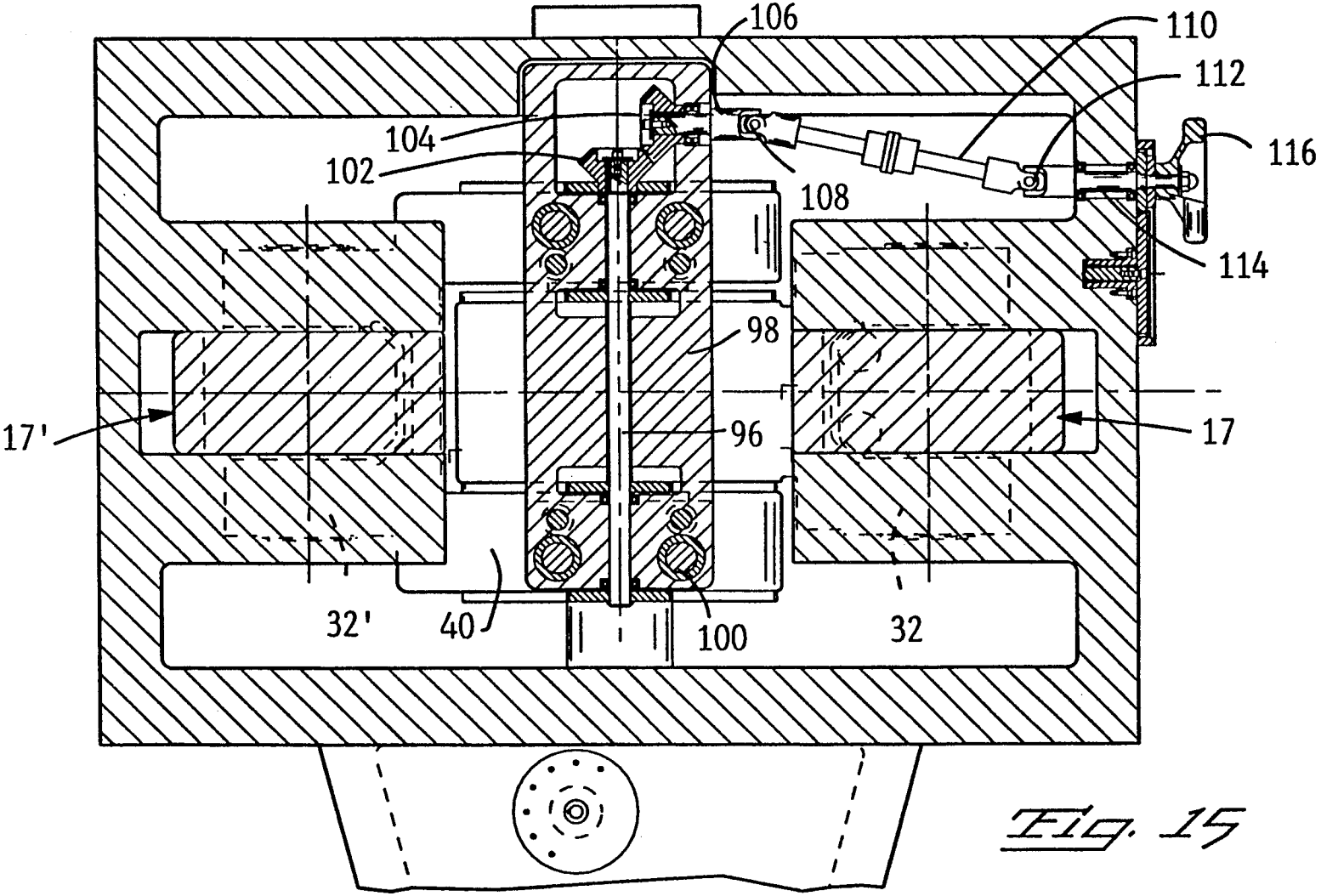

FIG. 15 is a view looking in the direction of the arrows 15—15 of FIG. 8.

THE DISCLOSED EMBODIMENT

Figure 1:
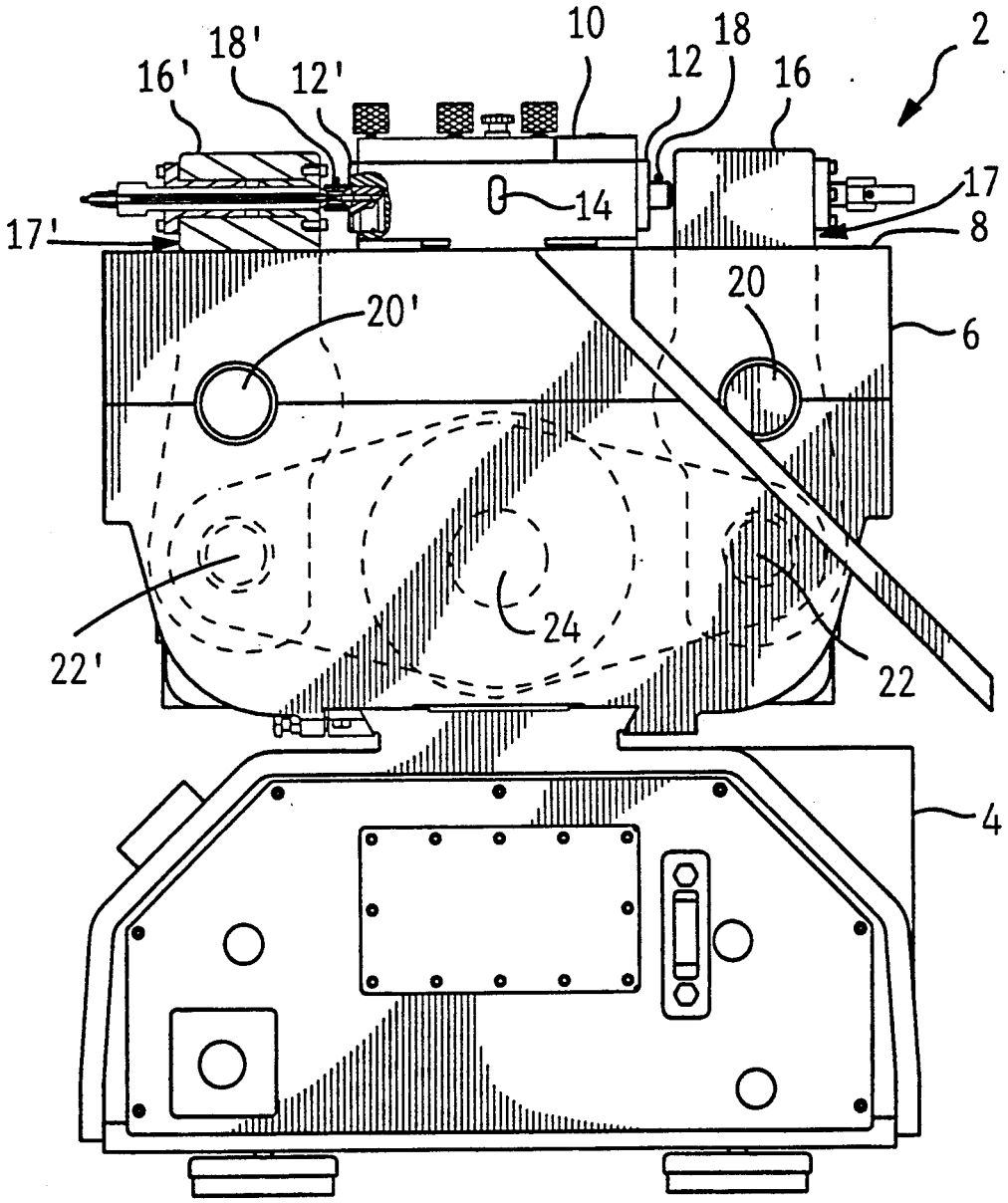

FIG. 1 shows a machine 2 of the type described in the above-identified U.S. patents and in application Ser. No. 07/929,255 filed Aug. 12, 1992. The machine has a base 4 which supports one or more machine modules 6. Each module has an upper surface 8 on which is mounted a ram housing 10 having a rectangular passageway extending therethrough. First and second ram assemblies 12,12' are contained in the ram housing and are reciprocable from the position shown towards and away from each other. The ram assemblies have tooling on their opposed ends for performing operations on strip material which is fed through aligned slots 14 in the housing 10.

The ram assemblies are reciprocated towards and away from each other by first and second levers 17,17', which are coupled to the rams as shown at 16,16', 18,18'. Each lever is pivoted intermediate its ends at 20,20' and its lower end is pivoted at 22,22' to the power shaft 24 by first and second eccentric assemblies shown diagrammatically at 27,27' in FIGS. 2 and 3. The eccentric assemblies are similar to each other and the corresponding parts of the eccentric assemblies are identified by the same reference numerals differentiated by prime marks. The first eccentric assembly will be described in detail.

Figure 2:
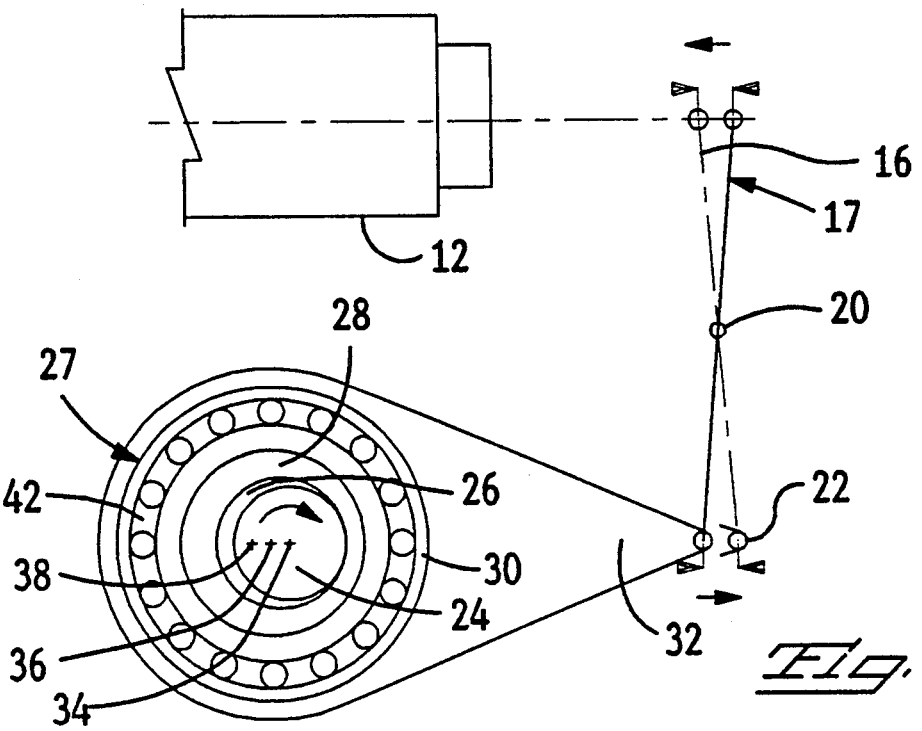

The first eccentric assembly 27, FIG. 2, comprises a fixed eccentric 26 which is integral with the power shaft 24 and an adjustable eccentric 28 which surrounds the fixed eccentric. The eccentric assembly is connected to the lower end of the lever 17 by a crank arm 32 which extends from a crank collar 30 that surrounds the adjustable eccentric 28. A roller bearing assembly 42 is provided between eccentric 28 and collar 30. The centers of the power shaft, the fixed eccentric, and the adjustable eccentric are shown at 34, 36, and 38.

Figure 3:
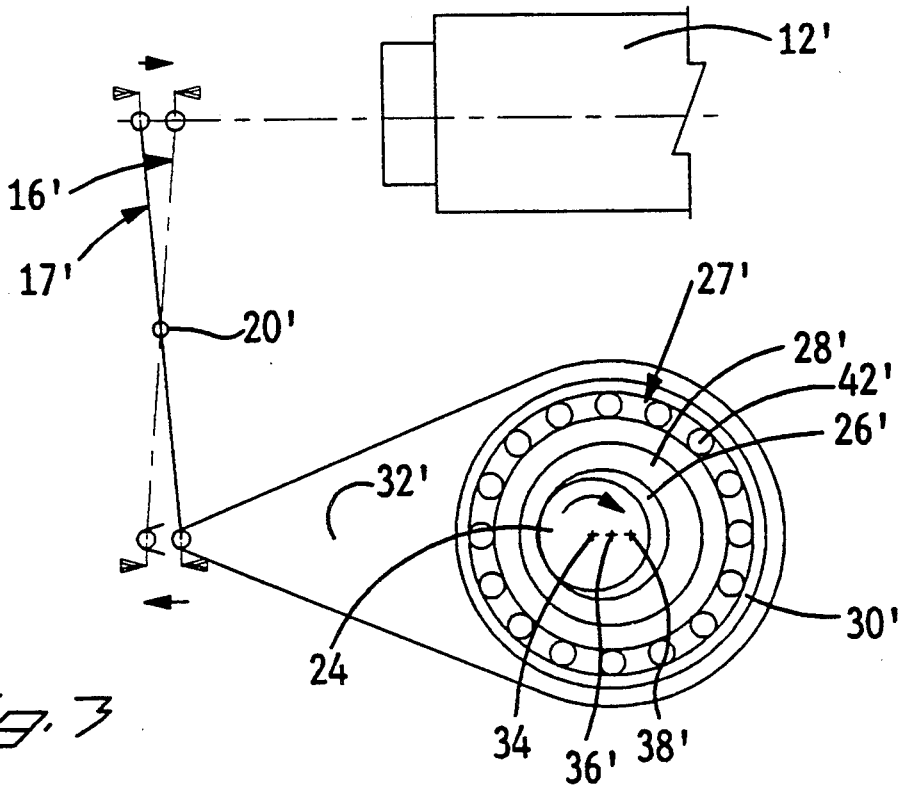
Figure 4:
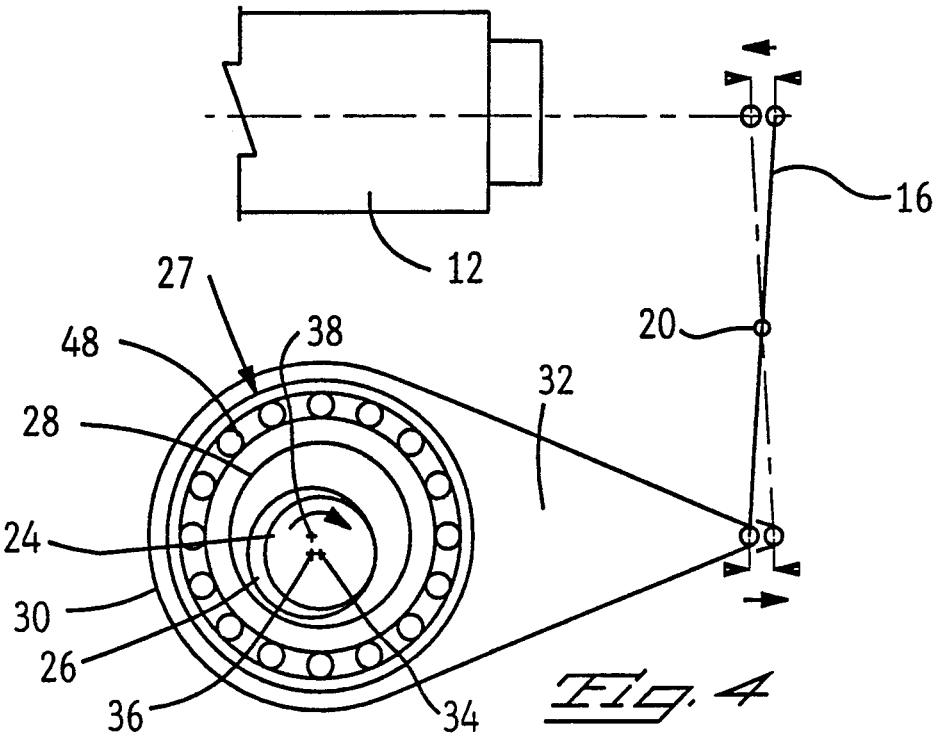
FIGS. 4 and 5 are views similar to FIGS. 2 and 3 but showing the positions of the adjustable eccentrics when their positions have been changed to provide a shortened stroke in the ram assemblies.
Figure 5:
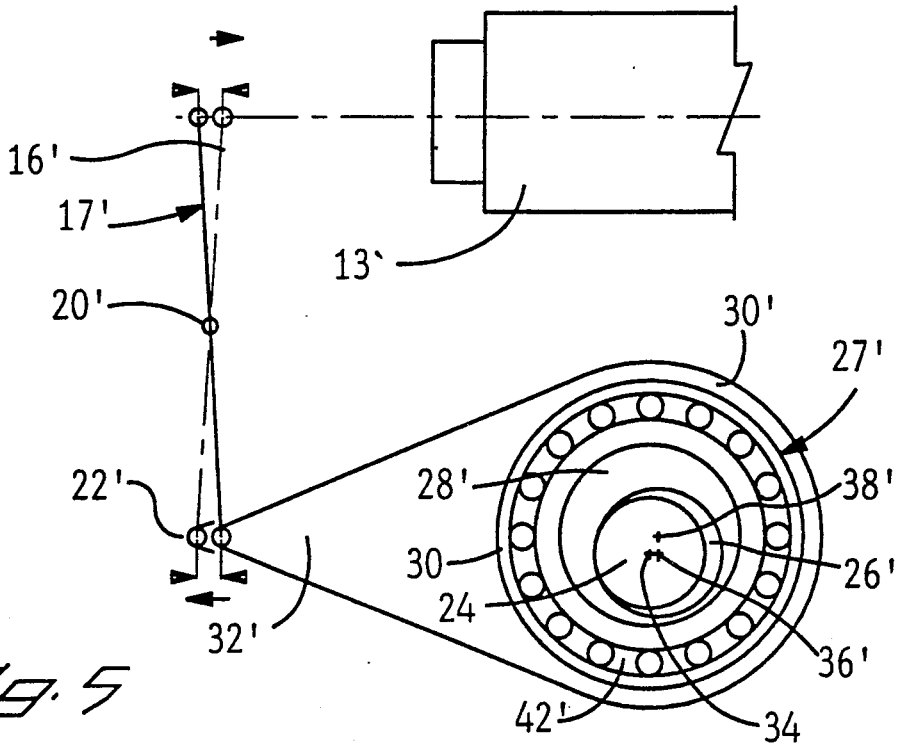
Figure 6:
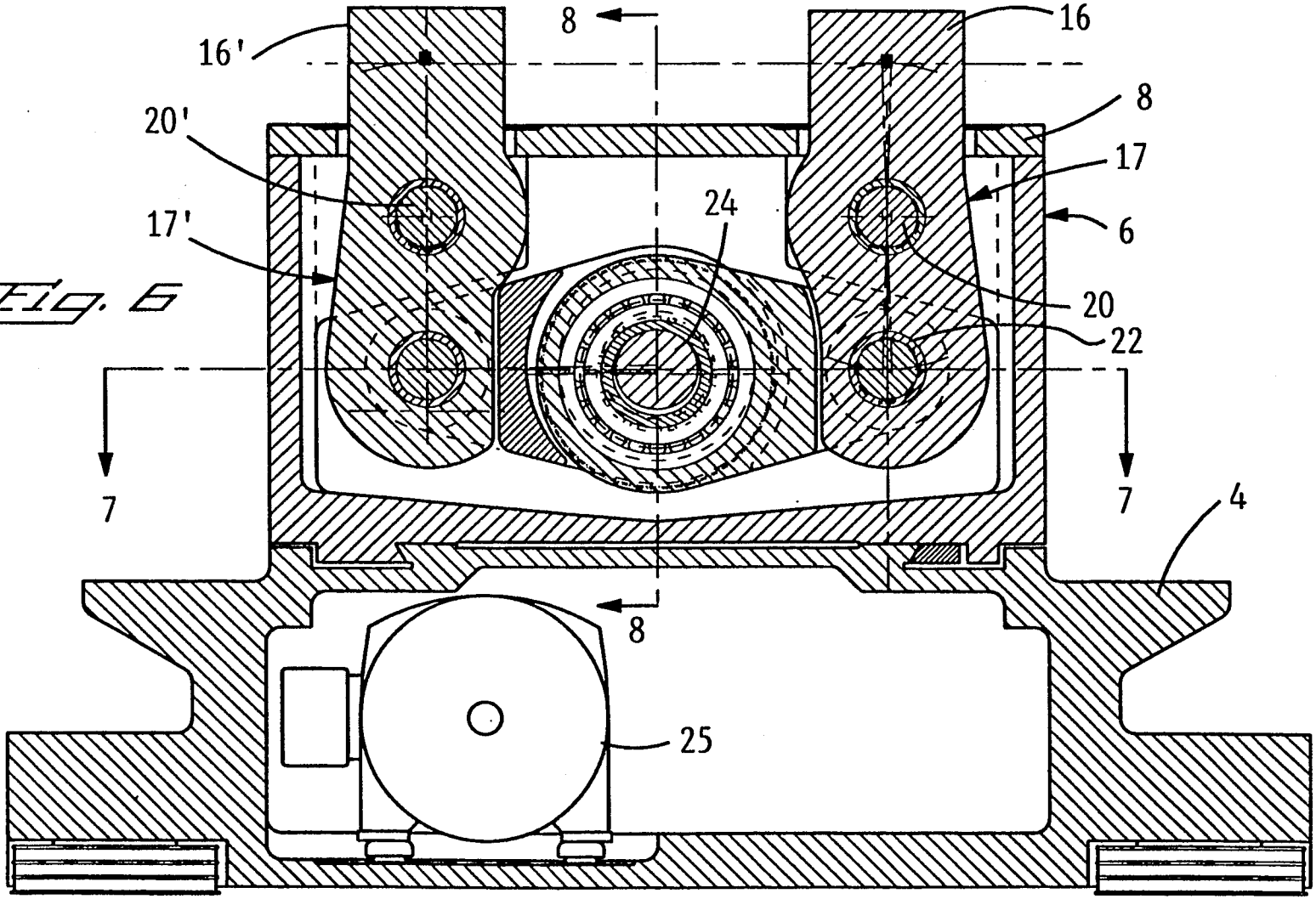
FIG. 6 is a sectional end view showing the power shaft and the eccentric assemblies. The ram housing and the ram assemblies have been omitted from this view.

The adjustable eccentrics 28,28' can be rotated, for adjustment purposes, from their positions shown in FIGS. 2 and 3 to shorten the strokes of the ram assemblies as shown in FIGS. 3 and 4. In these views, the adjustable eccentrics 28,28' have been rotated through an angle of 90° and it will be apparent from these views that this adjustment will result in a shortening of the strokes of the ram assemblies, 12,12'. When the adjustable eccentrics are rotated their centers 38,38' are rotated. The center 34 of shaft 24 and the centers 36,36' of the fixed eccentrics are unchanged. The adjustable eccentrics 28,28' must be fixed to the fixed eccentrics when the machine is being operated, however, they must be uncoupled from the fixed eccentrics when adjustments are made in their positions. The present invention discloses a coupling between the fixed and adjustable eccentrics which permits the adjustable eccentrics to be rotated and also discloses a means for simultaneously rotating the adjustable eccentrics for adjustment purposes.

FIGS. 7-15 show details of a machine module having an adjustable eccentric system in accordance with the present invention. This machine module differs in minor respects from the module shown in FIG. 1. However, the essential parts of the system are shown in FIG. 1.

Figure 7:
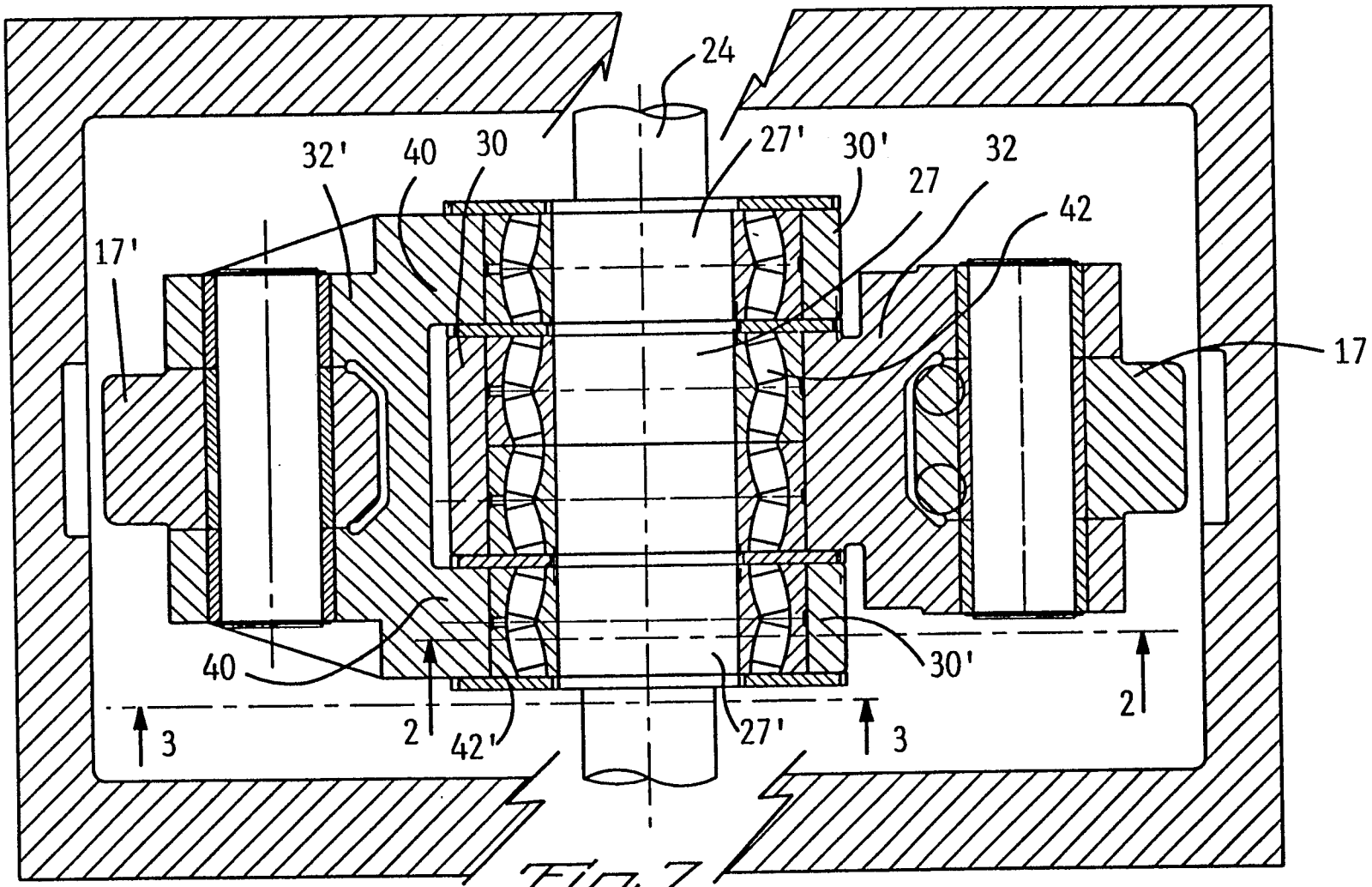
FIG. 7 is a sectional view looking in the direction of the arrows 7—7 of FIG. 6.

Referring to FIG. 7, the first eccentric assembly is on the end of the crank arm 32 and the second crank arm 32' has two extensions 40 on its end. The second eccentric assembly 27' comprises two parts, one part being in each of the arms 40 so that the first eccentric assembly 27 is between the two parts of the second eccentric assembly 27'. This arrangement provides a more balanced system when the shaft is rotating continuously. The roller bearing assemblies 42,42' are provided between the crank collars 30,30' and the adjustable eccentrics of both eccentric assemblies.

The securing means for securing the adjustable eccentric 28 of the first eccentric assembly 27 to the fixed first eccentric 26 will now be described with reference to FIGS. 9 and 10. The coupling means for the second eccentric assembly 27' will subsequently be briefly described.

Referring to FIG. 9, the fixed eccentric 26 has a fixed coupling collar 44 thereon between its ends and the first adjustable eccentric 28 is provided in two parts 28*a*,28*b* on each side of this fixed coupling collar. Slidable coupling collars or sleeves 46*a*,46*b* are mounted on the fixed eccentric adjacent to the fixed collar 44. The slidable sleeve 46*a*, which is on the right in FIG. 9, will be described in detail.

Sleeve 46*a* has a portion 48 which is beside the fixed collar 44 and which has radially extending teeth 52 thereon which, when the parts are in the position of FIG. 9, are interengaged with complimentary teeth on the side of the fixed collar 44. Sleeve 46*a* has an axially extending portion 50 which extends into a circumferential recess 51 in the eccentric section 28*a*. An axially extending coupling pin 54 is provided and is secured to the radially extending portion 48 of the sleeve 46*a* by means of a pin 56. Pin 54 extends through a counterbore 58, into a reduced diameter bore portion 60 in the eccentric portion 28 and has an end 72 which extends to a circumferential slot 62 in the eccentric section 28*a*. The pin has an integral collar 66 which is adjacent to the inner end of the counterbore 58 when the parts are in the positions of FIG. 9 and the pin is resiliently biased to its position shown by means of a spring 68 which extends from the collar 66 to a plug 70 at the entrance to the counterbore 58.

A disc 74, which is formed by two segments, is contained in the circumferential groove 62 and is rotatable in this groove. The spherical end 72 of the pin 54 bears against the surface 76 of disc 74 when the parts are in the positions of FIG. 9. Immediately adjacent to the end of the pin, two recesses or pockets 78, FIG. 10, are provided so that if the disc 74 is rotated a short distance, the spring 68 will urge the pin 54 rightwardly and its end 72 will enter one or the other of these pockets, depending upon whether the disc 74 is moved in a clockwise direction or a counterclockwise direction. When the pin moves in this manner, the slidable coupling sleeve 46*a* moves rightwardly by virtue of the fact that the pin 54 is connected to the sleeve 46*a* by the connecting pin 56, see FIG. 14. The section 28*a* of the first adjustable eccentric is thereby disengaged from the fixed collar 44 and the adjustable eccentric section 28*a* can be rotated for adjustment purposes on the fixed eccentric 26. At the same time, the eccentric section 28*a* is coupled to disc 74 by virtue of the fact that the end of pin 54 moves into one of the pockets 78. It is desirable to provide a friction means between the adjustable eccentric section 28*a* and the fixed eccentric 26 in order that the adjustable eccentric be rotatable but not freely rotatable. To this end, a plurality of radially extending threaded openings 80 are provided in the adjustable eccentric section and a threaded plug 82 is threaded into each of these openings. These plugs urge polyurethane pads 84 against the surface of the fixed eccentric so that rotation of the disc 74 is possible but some force must be applied in order to bring about such rotation.

When the disc 74 is rotated, the adjustable eccentric will be rotated when the end 72 of the coupling pin is in one of the pockets 78. The disc 74 is coupled to the adjustable eccentric by a lost motion connection comprising slots 86, FIG. 13 in the adjustable eccentric and screws extending into the discs which have their head portions 88 in these slots. When the disc is rotated the short distance required to permit the pins to move into the recesses, the heads 88 of these screws move against one end or the other of the associated arcuate slot 86 so that further rotation of the disc results in rotation of the adjustable eccentric.

The disc 74 and the corresponding disc on the section 28*b* of the adjustable eccentric are rotated by gears 90*a*,90*b* which mesh with gears on a rotating or adjusting mechanism as will be described below.

A plurality of coupling pins 54 are provided in each of the adjustable eccentric sections 28*a*,28*b*. Also, a plurality of slots and fasteners 88 are provided in the disc 74 and in the adjustable eccentric.

The section 28*b* of the adjustable eccentric is substantially identical to the section 28*a* and the coupling pins and the rotating plate 74 are substantially as described above.

The second adjustable eccentric is on the ends of the arms 40,40' of the second crank 32'. The second adjustable eccentric is therefore provided in two sections, one section being on each side of the first adjustable eccentric as best shown in FIG. 7. As can be seen from FIG. 8, each of the sections of the second adjustable eccentric is provided with coupling pins and the other parts described above with reference to FIG. 9.

The gears 90 which are secured to the discs 72 by fasteners 92 are intended to mesh with gears 94, FIGS. 8, 9, and 15, on a shaft 96 which is mounted in a frame 98 that extends parallel to the power shaft and is above the power shaft as viewed in FIG. 8. The shaft 96 has a bevel gear 102 on its end which is in mesh with a bevel gear 104 on a short shaft 106 that extends to a universal joint 108. A shaft 110 extends from the universal joint 108 to a universal joint 112 which is on a shaft 114 that extends from a hand wheel 116. The frame 98 can be lowered from the position shown in FIG. 8 thereby to bring the gears 94 into engagement with the gears 90 by piston-cylinder assemblies shown at 100. The cylinders of these piston cylinder assemblies are secured to the underside of the module housing 6 beneath the upper surface 8 and the piston rods of the assemblies are secured to the frame 98. Controls are provided for lowering the entire assembly on the frame 98 from the position shown in FIG. 8 when it is desired to change the positions of the adjustable eccentrics.

When it is desired to change the positions of the adjustable eccentrics 28,28' and thereby change the strokes of the ram assemblies 12,12', and the following steps are taken. The machine is stopped and the piston cylinder assemblies 100 are pressurized thereby to lower the frame 98 from the position shown in FIG. 8 and bring the gears 94 on the shaft 96 into engagement with the gears 90 on the discs 74. The hand wheel 104 is then rotated in the direction in which it is desired to rotate the adjustable eccentrics. Initially, the discs are rotated a short distance to bring the screw heads 88 to the end of the arcuate slots 86 and to move the disc 74 relative to the coupling pins so that the coupling pins move into one of the pockets or recesses 78 in the discs 74. Thereafter, the hand wheel 104 is rotated by an amount sufficient to bring about adjustment of the adjustable eccentrics by the desired amount. When the adjustable eccentrics are in their desired positions, the hand wheel is rotated in the reverse direction thereby to move the screw heads to the centers of the arcuate slots 86 and to move the coupling pins 54 against the force of their associated springs 68 into engagement with the fixed collars 44. When the coupling pins move leftwardly, they move out of the pockets in the disc 74 and the adjustable eccentrics are engaged with the fixed collar 44 and are coupled to the fixed eccentrics.

The foregoing explanation which is directed specifically to the adjustment system shown on the right in FIG. 9 applies also to the adjustment system on the left for the adjustable eccentric section 38*b* and also applies to the two sections of the second adjustable eccentric 28' in the ends of the arms 40 of the second crank arm 32'.

The advantage of the invention is that the strokes of the ram assemblies can be readily adjusted for different types of stamping and forming operations which are performed on the strip material which is fed through the machine. Shortening of the strokes of the ram, assemblies results in the development of higher forces in the ram assemblies which permits operations to be performed on relatively thick material.

I claim:

1. A machine comprising at least one reciprocable ram, a power shaft and an eccentric assembly for reciprocating the ram, the machine being characterized in that:

the eccentric assembly comprises a fixed eccentric and an adjustable eccentric, the fixed eccentric being fixed to the shaft, the adjustable eccentric surrounding the fixed eccentric and being rotatable, for adjustment purposes, with respect to the fixed eccentric, and disengageable securing means for securing the adjustable eccentric in position relative to the fixed eccentric including a coupling collar fixed to the fixed eccentric and a coupling sleeve coupled to the adjustable eccentric and movable into coupled engagement with the coupling collar and movable in an opposite direction for disengagement from the coupling collar, whereby, the length of the stroke of the rams can be changed by adjusting the position of the adjustable eccentric on the fixed eccentric.

2. A machine as set forth in claim 1 characterized in that the securing means is automatically disengaged when the adjustable eccentric is adjusted.

3. A machine as set forth in claim 2 characterized in that a lever is provided which is pivoted between its ends on a fixed pivotal axis, one end of the lever being coupled to the eccentric assembly by a crank, the other end of the lever being coupled to the ram.

4. A machine comprising first and second ram assemblies which are reciprocable towards and away from each other between forward and retracted positions, first and second actuator levers for reciprocating the ram assemblies, each lever being coupled to its associated ram assembly and having a fixed pivot, a power shaft, the first and second levers being coupled to the power shaft by first and second eccentric coupling assemblies, the machine being characterized in that:

each of the eccentric coupling assemblies comprises a fixed eccentric and an adjustable eccentric, the fixed eccentric being fixed on the power shaft, the adjustable eccentric surrounding the fixed eccentric and being rotatable, relative to the fixed eccentric, for adjustment purposes, and disengageable securing means for securing the adjustable eccentric in position relative to the fixed eccentric including a coupling collar fixed to the fixed eccentric and a coupling sleeve coupled to the adjustable eccentric and movable into coupled engagement with the coupling collar and movable in an opposite direction for disengagement from the coupling collar, whereby, the lengths of the strokes of the ram assemblies can be adjusted by adjusting the positions of the adjustable eccentrics relative to the fixed eccentrics.

5. A machine as set forth in claim 4 characterized in that each securing means is automatically disengaged when the adjustable eccentric is adjusted.

6. A machine as set forth in claim 5 characterized in that a single adjusting means is provided for disengaging the securing means of the first and second eccentric assemblies, for adjusting the positions of the adjustable eccentrics of the first and second eccentric assemblies, and for then re-engaging the securing means.

7. A machine as set forth in claim 4, characterized in that each of the actuator levers is pivoted intermediate its ends, one end of each lever being connected to its associated eccentric assembly, the other end of each lever being coupled to its associated ram assembly.

8. A machine as set forth in claim 7 characterized in that each adjustable eccentric comprises an eccentric collar which surrounds its associated fixed eccentric, each of the eccentric couplings comprises a crank which extends from the associated adjustable eccentric to the associated lever.

9. A machine as set forth in claim 8 characterized in that each crank has a crank collar which surrounds its associated adjustable eccentric.

10. A machine as set forth in claim 4 characterized in that each fixed coupling collar is fixed to, and surrounding, its associated fixed eccentric, the movable coupling sleeve being movable axially on its associated fixed eccentric between a coupled position and an uncoupled position, the movable coupling sleeve being coupled to its associated fixed collar when in its coupled position and being uncoupled from its associated fixed collar when in its uncoupled position whereby the adjustable eccentric is coupled to the associated fixed eccentric when the movable sleeve is in its coupled position and the adjustable eccentric is uncoupled from the associated fixed eccentric when the movable sleeve is in its uncoupled position.

11. A machine as set forth in claim 10 characterized in that the movable coupling sleeve is connected to the adjustable eccentric by axially extending pin means, the pin means being fixed to the movable sleeve and extending slidably into the adjustable eccentric.

12. A machine as set forth in claim 4 characterized in that each fixed coupling collar is fixed to, and surrounding, the associated fixed eccentric, the movable coupling sleeve surrounding the associated fixed eccentric and being axially movable between an engaged position and a disengaged position, the adjustable eccentric being engaged with the fixed coupling collar when the movable coupling sleeve is in its engaged position and being disengaged from the fixed coupling collar when the movable coupling sleeve is in its disengaged position.

13. A machine as set forth in claim 12 characterized in that each movable coupling sleeve is coupled to its associated adjustable eccentric by axially extending pins.

14. A machine as set forth in claim 13 characterized in that the axially extending pins are fixed to the movable coupling sleeve and are slidably received in the associated adjustable eccentric.

15. A machine as set forth in claim 12 characterized in that a single adjusting means is provided for disengaging the securing means of the first and second eccentric assemblies, for adjusting the positions of the adjustable eccentrics of the first and second eccentric assemblies, and for then reengaging the securing means.

16. A machine as set forth in claim 15 characterized in that the single adjusting means comprises an adjusting shaft which extends parallel to the power shaft, gears on the adjusting shaft, and gears on the adjustable eccentrics, the adjusting shaft being movable laterally of its axis towards and away from the power shaft between an adjacent position and a remote position, the gears on the adjusting shaft being meshed with the gears on the adjustable eccentric when the adjusting shaft is in its adjacent position whereby rotation of the adjusting shaft will cause rotation of the adjustable eccentrics.

17. A stamping and forming machine comprising first and second aligned ram assemblies which are reciprocable towards and away from each other along paths of reciprocation between retracted positions and forward positions, first and second levers for reciprocating the first and second ram assemblies, one end of each lever being coupled to its associated ram assembly, the levers being pivotally mounted on first and second pivotal axes, a power shaft, the first and second levers being coupled to the power shaft by first and second eccentric assemblies, the machine being characterized in that:

the first eccentric assembly comprises a first fixed eccentric, a first adjustable eccentric, and a first crank, the second eccentric assembly comprising a second fixed eccentric, a second adjustable eccentric, and a second crank, each of the fixed eccentrics being fixed to the power shaft, each of the adjustable eccentrics surrounding its associated fixed eccentrics and being rotatable, for adjustment purposes, with respect to its associated fixed eccentric, each of the cranks extending from its associated adjustable eccentric to its associated lever and being pivotally connected to its associated lever, and each first and second eccentric assembly includes a disengageable securing means for securing its adjustable eccentric in position relative to its fixed eccentric including a coupling collar fixed to the fixed eccentric and a coupling sleeve coupled to the adjustable eccentric and movable into coupled engagement with the coupling collar and movable in an opposite direction for disengagement from the coupling collar, whereby, the lengths of the strokes of the ram assemblies can be changed by adjusting the positions of the adjustable eccentrics.

18. A machine as set forth in claim 17 characterized in that each of the cranks has an inner end which is coupled to its associated adjustable eccentric and an outer end which is pivotally connected to its associated lever, the inner end of the second crank having a pair of spaced apart arms, the inner end of the first crank being between the arms.

19. A machine as set forth in claim 18 characterized in that in each eccentric assembly the securing means is automatically disengaged when the adjustable eccentric is adjusted.

20. A machine as set forth in claim 19 characterized in that each fixed coupling collar is fixed to, and surrounding, its associated fixed eccentric, the movable coupling collar being movable axially on its associated fixed eccentric between a coupled position and an uncoupled position, the movable coupling collar being coupled to its associated fixed collar when in its coupled position and being uncoupled from its associated fixed collar when in its uncoupled position whereby the adjustable eccentric is coupled to the associated fixed eccentric when the movable collar is in its coupled position and the adjustable eccentric is uncoupled from the associated fixed eccentric when the movable collar is in its uncoupled position.

21. A machine as set forth in claim 20 characterized in that the movable coupling collar is connected to the adjustable eccentric by axially extending pin means, the pine means being fixed to the movable collar and extending slidably into the adjustable eccentric.

22. A machine as set forth in claim 21 characterized in that a single adjusting means is provided for disengaging the securing means of the first and second eccentric assemblies, for adjusting the positions of the adjustable eccentrics of the first and second eccentric assemblies, and for then reengaging the securing means.

23. A machine as set forth in claim 22 characterized in that the single adjusting means comprises an adjusting shaft which extends parallel to the power shaft, gears on the adjusting shaft, and gears on the adjustable eccentrics, the adjusting shaft being movable laterally of its axis towards and away from the power shaft between an adjacent position and a remote position, the gears being meshed when the adjusting shaft is in its adjacent position whereby rotation of the adjusting shaft will cause rotation of the adjustable eccentrics.

* * * * *